US005871040A

United States Patent [19]

Kaseda et al.

[11] Patent Number: 5,871,040

[45] Date of Patent: Feb. 16, 1999

[54] PROCESS FOR CONTINUOUSLY CASTING THIN SLABS

[75] Inventors: Sadamichi Kaseda, Kawanishi; Kazuo Okamura, Nishinomiya; Sei Hiraki, Kashima; Takashi Kanazawa, Kashima; Seiji Kumakura, Kashima; Akihiro Yamanaka, Kashima, all of Japan

[73] Assignee: Sumitomo Metal Industries, Ltd., Osaka, Japan

[21] Appl. No.: 793,258

[22] PCT Filed: Jun. 18, 1996

[86] PCT No.: PCT/JP96/01668

§ 371 Date: Feb. 21, 1997

§ 102(e) Date: Feb. 21, 1997

[87] PCT Pub. No.: WO97/00747

PCT Pub. Date: Jan. 9, 1997

[30] Foreign Application Priority Data

| | | | |
|---|---|---|---|
| Jun. 21, 1995 | [JP] | Japan | 7-154990 |
| Jun. 29, 1995 | [JP] | Japan | 7-163167 |
| Jan. 12, 1996 | [JP] | Japan | 8-003454 |

[51] Int. Cl.[6] ..... B22D 11/12; B22D 11/22; B22D 27/02

[52] U.S. Cl. ..... 164/476; 164/485; 164/486; 164/455; 164/458; 164/466; 164/414

[58] Field of Search ..... 164/476, 486, 164/455, 458, 485, 443, 444, 414, 466, 502

[56] References Cited

U.S. PATENT DOCUMENTS

| | | | |
|---|---|---|---|
| 4,513,491 | 4/1985 | Bohnenkamp | 164/476 |
| 4,519,439 | 5/1985 | Fredriksson et al. | 164/476 |
| 5,307,863 | 5/1994 | Kubota et al. | 164/466 |
| 5,381,857 | 1/1995 | Tozawa et al. | 164/466 |

FOREIGN PATENT DOCUMENTS

| | | | |
|---|---|---|---|
| 63-108955 | 5/1988 | Japan . | |
| 63-112048 | 5/1988 | Japan . | |
| 63-171255 | 7/1988 | Japan . | |
| 63-242454 | 10/1988 | Japan | 164/476 |
| 2-52159 | 2/1990 | Japan . | |
| 2-151354 | 6/1990 | Japan | 164/476 |
| 3-174962 | 7/1991 | Japan . | |
| 5-138321 | 6/1993 | Japan | 164/455 |
| 5-200491 | 8/1993 | Japan | 164/476 |
| 5-237621 | 9/1993 | Japan . | |
| 7-40005 | 2/1995 | Japan . | |
| 7-132355 | 5/1995 | Japan . | |

*Primary Examiner*—Patrick Ryan
*Assistant Examiner*—I.-H. Lin
*Attorney, Agent, or Firm*—Burns, Doane, Swecker & Mathis, LLP

[57] ABSTRACT

In producing thin slabs by continuous casting, a method is developed in which internal defects are reduced to improve a production yield. Narrow sides of cast slabs are cooled in a controlled manner to produce cast slabs having a projection in a center of each of the narrow sides to a height of 5–10 mm above the level of the edge portions, and squeeze reduction with a reduction of 10–45% is carried out while an unsolidified portion of the narrow sides of the slab is within 50–80% of the thickness of the cast slab.

8 Claims, 5 Drawing Sheets

PROCESS FOR CONTINUOUSLY CASTING THIN SLABS

TECHNICAL FIELD

This invention relates to a process for continuously casting thin slabs which have an improved inner quality and which are free of internal defects, such as center segregation and internal cracking.

BACKGROUND ART

A typical process for making thin plates comprises continuously casting slabs, cooling the slabs, and then subjecting the once-cooled slabs to hot rolling. According to this process, however, it is necessary to heat the slabs which have been air-cooled after casting, and this process is disadvantageous with respect to energy consumption.

Recently, in view of the advantage that it can reduce energy costs markedly, a direct rolling process has been employed. The direct rolling process is a process for directly supplying cast slabs from a continuous casting machine to a hot rolling mill without intentional cooling. When thin cast slabs are used, it is possible to omit rough hot rolling steps from the direct rolling process. Currently, many attempts have been made to develop a new and practical continuous casting process for such thin slabs.

The direct rolling process using such thin slabs is advantageous because it is possible to omit rough hot rolling steps and because it is possible to achieve a less-energy consuming and more simplified process as a whole process for making steels in more efficient manner.

One such process for producing thin slabs is a process for casting slabs using a rectangular mold, in which a cast slab is rolled under a controlled roll pressure with controlled reductions using a plurality pairs of rolls while unsolidified portions remain in central portions of the slab. See Japan Unexamined Patent Application Laid-Open Specification No. 2-52159.

Using such processes in which cast slabs are reduced in thickness while unsolidified portions remain in central portions thereof (hereunder called "squeeze reduction"), it is possible to force out a molten phase enriched in solutes in the central portion of the slab upwardly to a mold so that cast slabs substantially free from segregation in liquid core can be obtained. Such segregation in the central portion is caused by the solidification of molten steel enriched in solutes. When the amount of rolling reduction during the molten state is adjusted, it is possible to manufacture thin slabs having a given range of thickness from slabs cast in a mold having a predetermined size of thickness.

According to a process disclosed in the above-mentioned JP-A 2-52159, however, cast slabs are produced with a rectangular mold, and tensile stresses are found along a solid-liquid interface in a longitudinal section during squeeze reduction. Such tensile strains sometimes cause cracking within the slabs.

Such a tendency is remarkable when the casting is carried out at a high speed and the reduction is relatively large. If there are many internal cracks in a cast slab, it is impossible to manufacture a rolled product through finish rolling. Thus, the reduction in thickness during squeeze reduction is restricted, and the merits of squeeze reduction cannot be enjoyed sufficiently when high speed casting is carried out.

On the other hand, as the casting speed increases, the pouring rate of molten steel into a mold through an immersion nozzle and the flow velocity are also increased, resulting in insufficient separation of inclusions within a residence time of molten steel in the mold. An increase in the amount of inclusions within slabs is inevitable. Thus, even if segregation in central portions can be forced out by squeeze reduction, it tends to be impossible to suppress an increase in inclusions, and clean steels free from internal defects cannot be obtained when the casting speed is high. In such a case, the advantages of squeeze reduction cannot be attained sufficiently.

In order to cope with an increase in casting speed, which is required recently, it is necessary to suppress the formation of internal cracks of cast slabs as well as segregation in the central portions, and it is also necessary to improve the cleanliness of cast slabs.

SUMMARY OF THE INVENTION

An object, therefore, of the present invention is to develop a process for reducing internal cracking to improve the yield of the product in the manufacture of thin slabs.

Another object of the present invention is to provide a process for producing thin slabs at such a casting speed of 2–8 m/min as currently used in a current high speed casting method, and carrying out squeeze reduction with a reduction of 5–50% to produce with a high yield thin slabs which have a thickness of 30–150 mm and which are free from internal cracking.

Still another object of the invention is to provide a continuous casting process for producing thin slabs free from internal cracking as well as center segregation with cleanliness of the slabs being further improved by reducing the amount of inclusions.

Internal cracking can be classified as internal cracking near the narrow sides in the longitudinal cross section (hereunder called "vertical cracking" or "vertical cracks") and cracking found at the corners of the transverse cross section (hereunder called "corner cracking" or "vertical cracks") of the slab.

FIGS. 1*a*–1*c* are illustrations of the locations and shapes of these types of internal cracking, in which FIG. 1*a* is a schematic view of a cast slab 14, FIG. 1*b* is a longitudinal cross section along line I—I of FIG. 1*a,* in which a series of vertical cracks 9 are formed in the longitudinal direction, and FIG. 1*c* is a transverse cross section along line II—II of FIG. 1*a,* in which corner cracks 8 are formed at the four corners of the cross section. It is apparent that the vertical cracks 9 and corner cracks 8 are different from each other with respect to the propagating direction as well as the location of the cracking.

FIG. 2 is a graph showing the frequency of occurrence of cracking from the central portion to the edge portions of the slab in the transverse cross section of FIG. 1*c*. The peaks at the both edges indicate the occurrence of the corner cracking 8, and the flared portions till the central flat portion indicate an area where vertical cracking occurs. This graph is intended to show a general tendency and does not indicate the exact amount of cracking at any location.

The inventors of the present invention investigated the cause of the formation of internal cracking and found that the vertical cracks 9 of the slab is a result of a tensile stress being applied to the narrow sides of solidified shell portion in the longitudinal cross section of the slab during squeeze reduction. The inventors therefore noted that it is advantageous to form the narrow side of a slab into a convex shape during squeeze reduction so as to avoid internal cracking. In addition, after studying how to avoid the formation of corner cracks 8 in a transverse cross section of a slab, the inventors found that it is possible to solve such problems by thickening the solidified shell portion thoroughly during squeeze reduction. The present invention is based on these findings.

The present invention resides in a process for continuously casting a thin cast slab with a continuous casting machine comprising a mold, guide rolls, and reduction rolls arranged in that order, and continuously applying squeeze reduction to the cast slab, characterized in that the narrow sides of the cast slab having a convex shape are cooled in a controlled manner to prepare a solidified thickness sufficiently thick to prevent corner cracking of the cast slab.

The expression "solidified thickness sufficiently thick to prevent corner cracking" means a solidified shell thickness which is large enough to produce strains due to bending deformation at the narrow sides of the cast slab during the squeeze reduction in such an amount that the strains generated at the corners or near the corners are smaller than the critical strain for internal cracking. Needless to say, a minimum thickness of the solidified shell is required to prevent a breakout of molten metal during squeeze reduction.

In practice, since a referable solidified shell thickness varies depending on the reduction rate during the squeeze reduction, the shapes of the narrow sides of the slab, etc., it is advisable to use the most suitable one from a data base comprising data or the relationship between the shape of the narrow sides of the cast slab and reduction strains, and the relationship between the solidified shell thickness and rolling strains, which are previously determined, stored, and sometimes replaced with new relationships.

More specifically, when the cast slab thickness is 50–200 mm, the thickness of the solidified shell at the narrow sides may be adjusted to be 20–50% of the slab thickness so as to successfully prevent corner cracking.

When a target thickness of the solidified shell is determined in this manner, cooling conditions of the mold and cooling apparatus are determined. For this purpose, the relationship between the heat transfer rate of the mold wall at the narrow sides and the thickness of the solidified shell at the narrow sides of the mold, and the relationship between the heat transfer rate of the mold wall at the narrow sides during water-cooling with a cooling apparatus and the increment of solidified shell thickness at the narrow sides of the slab are previously obtained. Based on these relationships, cooling conditions of the mold as well as cooling conditions by a cooling apparatus can be determined at the beginning of the squeeze reduction so as to obtain the before-mentioned target solidified shell thickness.

According to a preferred embodiment of the present invention, using a continuous casting machine comprising a mold having convex-shaped narrow sides, guide rolls, and reduction rolls in that order, cooling of the narrow sides of the mold and of the narrow sides of a thin slab during the time between the point just downstream from the mold and a reduction rolling zone equipped with reduction rolls is controlled so as to prepare a solidified shell thickness sufficiently thick to prevent internal cracking of the cast slab.

In this case, the cast slab may be roll-reduced by 5–50% of the thickness of the slab if the thickness of the unsolidified phase is within 10–90% of the slab thickness.

Thus, according to the present invention, vertical cracking found in the longitudinal section at the narrow sides of the slab can be prevented by using a mold having convex narrow sides. The same effect can be achieved by using a rectangular mold to prepare a rectangular slab, and by shaping the narrow sides thereof into a convex shape before carrying out squeeze reduction. According to another embodiment of the present invention, therefore, after pouring into a rectangular mold, the narrow sides of the resulting slab are cooled in a controlled manner so as to make the narrow sides convex, in which the central portion of a narrow side projects with respect to the edge portions.

According to this embodiment, therefore, bulging taking place during processing from the time when the slab leaves the mold to a squeeze reduction zone is utilized to previously determine the relationship between the thickness of the solidified shell at the narrow sides at the time when the slab just leaves the mold and the amount of bulging at the narrow sides, and based on this relationship, the cooling conditions for the narrow sides can be determined.

In this case, for example, cooling conditions for the narrow sides after leaving the mold can be controlled so as to prepare a cast slab having a bulge projecting 5–10 mm, and the resulting slab is subjected to a reduction of 10–45% while the thickness of the unsolidified phase at the narrow sides is 50–80% of the thickness of the cast slab.

Application of the electromagnetic braking system to a molten metal poured into a mold is advantageous. Depending on the amount of squeeze reduction of the slab (changes in throughput), the magnetic field strength of the electromagnetic braking system (EMBr) is controlled so as to adjust the flow-out rate of molten steel within the mold, resulting in a further improvement in cleanliness of the squeeze rolled slab.

According to still another embodiment of the present invention, therefore, by using the EMBr system, a magnetic field is applied to a flow of molten steel passing from an immersion nozzle to within a mold in the direction opposite to the direction of the molten metal flow so that the flow rate can be braked during pouring into the mold, and after leaving the mold squeeze reduction is applied to the slab. The magnetic field intensity necessary for braking the flow of molten steel through the EMBr system may be controlled based on the ratio of the throughput of the molten steel after squeeze reduction to the throughput of the molten steel before squeeze reduction.

In this method, the magnetic field intensity F for braking is preferably defined by the reduction $\Delta L(=L_0-L_1)$ in accordance with the following formula (1):

$$F_1=[(L_0-\Delta L)\cdot W_1)/(L_0\cdot W_0)]\cdot F_0 \quad (1)$$

wherein F: magnetic field intensity (Gauss)

L: thickness of cast slab (m)

W: width of cast slab (m)

Appendix 0: before squeeze reduction

Appendix 1: after squeeze reduction

Formula (1) can be derived from the ratio of the throughput after squeeze reduction $[(L_1\cdot W_1 V_C)\ X\ \rho]$ (ton/min) to the throughput before squeeze reduction $[(L_0\cdot W_0 V_C)\ X\ \rho]$ (ton/min), which further comprises a correction factor based on the shape on the wide sides (width) of the slab, the narrow sides (thickness) of which were deformed into a convex shape by buckling, depending on casting mold conditions (width, dumping of magnetic field intensity within the mold, etc.) and squeeze reduction conditions. The term $V_C$ stands for casting speed (m/min) and $\rho$ stands for molten metal density (7 ton/m$^3$).

Since a variation $\Delta W$ is very small compared with $W_0$, in the application of the above-mentioned Formula (1), the throughput of the molten steel after squeeze reduction can be determined without any practical problems, provided that $W_1$ is substantially equal to $W_0$, i.e., $W_1 \approx W_0$.

BRIEF DESCRIPTION OF THE DRAWINGS

FIGS. 1*a*–1*c* are illustrations of locations and shapes of internal cracks, in which FIG. 1*a* is a schematic view of a cast slab 14, FIG. 1*b* is a sectional view of the narrow side of the slab cut along line I—I of FIG. 1*a,* in which vertical cracks 9 are formed over a region extending in the longitudinal direction, and FIG. 1*c* is a cross section along line II—II of FIG. 1*a*.

BEST MODE FOR CARRYING OUT THE INVENTION

The present invention will be described below more specifically with reference to the accompanying drawings.

Figure 3:
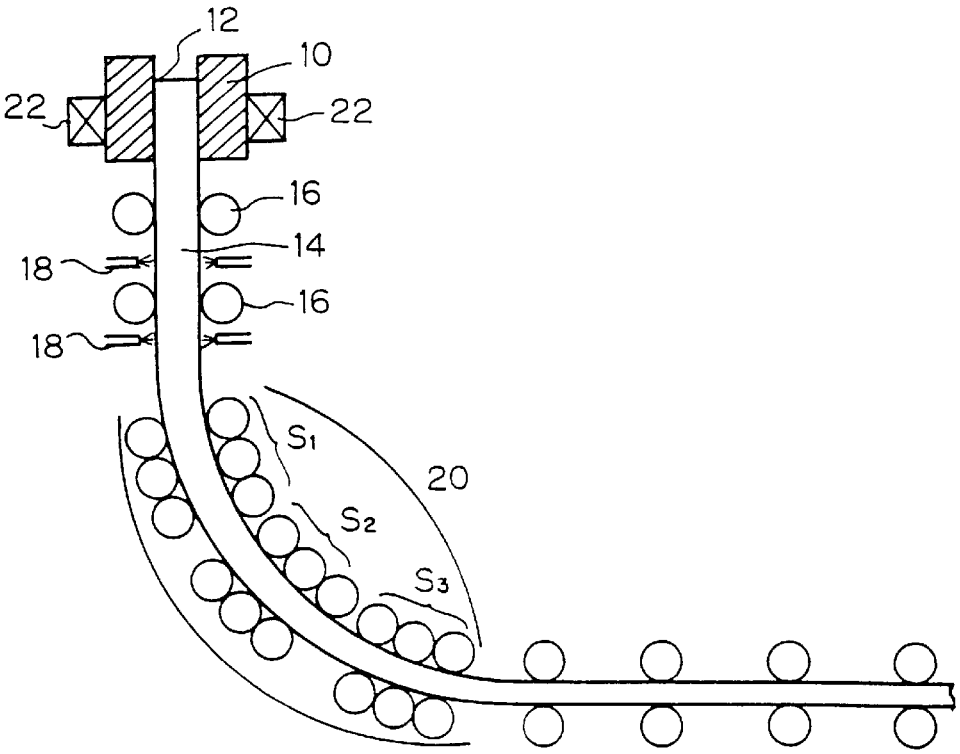
FIG. 3 is a schematic view of a continuous casting machine employed in the present invention.

FIG. 3 schematically shows a continuous casting machine employed in the present invention. In the illustrated machine, a mold is provided with a magnetic brake, and an additional cooling means is provided at the position of guide rolls. These are not essential to the present invention.

As shown in FIG. 3, molten steel poured into a mold 10 starts being solidified from a meniscus portion 12, and the inner side remains unsolidified. The mold is provided with slits in the surface portion of the side walls, or it is provided with cooling pipes in the side walls so that the wide sides and narrow sides of the mold can be cooled independently from each other. Namely, the wide sides and narrow sides of the mold have respective, independent cooling control mechanisms.

A cast slab 14 withdrawn from the mold is guided with guide rolls 16, and, if necessary, is cooled with cooling means 18 provided between the guide rolls. The cooling means 18 are provided on both the wide sides and narrow sides, and they are controlled independently of each other so as to cool the wide and narrow sides uniformly. Since a magnetic brake 22 is known in the art in detail, it is schematically shown in the drawings. The magnetic brake 22 can control the flow velocity of molten steel flowing out of an immersion nozzle (not sown). The flow velocity increases as the casting speed increases.

Figure 4A:
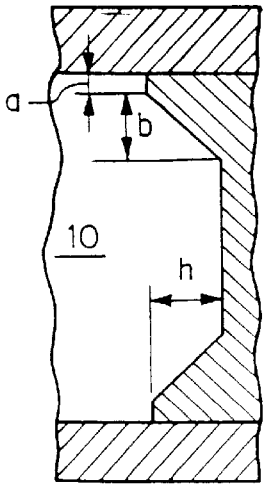
FIGS. 4*a* through 4*c* are schematic sectional view of molds having convex narrow sides and molds of the rectangular type.
Figure 4B:
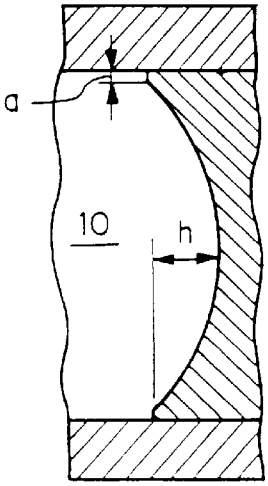
Figure 4C:
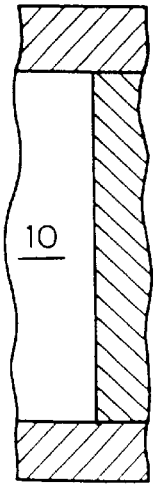

FIGS. 4*a* and 4*b* are schematic illustrations of part of a section of a mold 10 having convex narrow sides, in which FIG. 4*a* shows a mold having a trapezoidal sectional shape on both the narrow sides (hereinafter referred to as a "trapezoidal mold"), and FIG. 4*b* shows a mold having a circular sectional shape on both the narrow sides (hereinafter referred to as a "circular mold"). These two molds are collectively referred to as "convex molds". FIG. 4*c* shows a sectional view of a mold 10 having flat, narrow sides (hereinafter referred to as "rectangular mold"). Though the mold is not limited to these specific values, in these figures, the molds have the dimensions a: 2.5–10.0 mm, b: 10–25 mm, and h: 5–30 mm.

When the mold has convex narrow sides in cross section, a dimension in the thickness direction within the mold cavity, i.e., the narrow side dimension within the mold, is preferably 60–150 mm. When the thickness is less than 60 mm, a pouring nozzle must be of a flat type, and each flat nozzle must be designed and manufactured for a specific mold. It is rather difficult, however, to supply a molten metal to a mold in a controlled flow rate, even if such a flat nozzle is employed. On the other hand, if the dimension in the thickness direction is over 150 mm, it is necessary to increase reductions with reduction rolls of a continuous casting machine as well as reductions during a rolling step in order to manufacture thin slabs, and the increased reductions are not desirable from the viewpoint of saving costs and energy.

A roll reduction zone is divided into at least three segments $S_1$–$S_3$, in each of which at least three reduction rolls 20 are provided. The reduction incline of roll alignment is constant within any one of the roll reduction zones, and the reduction incline may be changed, if necessary, from zone to zone.

Thus, according to the present invention, in the manufacture of thin slabs through a continuous casting process using continuous squeeze reduction, the continuous squeeze reduction is carried out after adjusting the thickness of a solidified shell to a value large enough to prevent corner cracking in the cast slabs by controlling cooling of the narrow sides having a convex cross-sectional shape.

As long as cast slabs having convex-shaped narrow sides can be obtained at the time of carrying out the squeeze reduction, a mold having convex narrow sides or a rectangular mold may be used. In order to achieve a solidified shell thickness large enough to prevent corner cracking, when a mold having convex narrow sides is employed, cooling is controlled so that a desired range of solidified shell thickness is obtained in an area within the mold and guide rolls. When a rectangular mold is employed, after formation of bulges at the narrow sides in an area of guide rolls after with drawing the slab from the mold, cooling is controlled so that a desired range of solidified shell thickness is obtained.

When cast slabs having convex narrow sides are processed, during squeeze reduction, an extended deformation in the casting direction, which is caused by squeeze reduction, is so small that the occurrence of vertical cracking can be prevented. However, tensile strains in the direction of the cast slab width found in the solidified front near the corner portions, which are caused by roll reduction, cannot be suppressed, and there is still the danger of corner cracking occurring.

In order to suppress such a danger, when a mold having convex narrow sides is employed, according to the present invention, both the narrow sides of a mold and narrow sides of a cast slab in an area just after the slab has left the mold to the roll reduction zone are cooled extensively to thicken the solidified shell on both the narrow sides of the cast slab so that bending deformation on the narrow sides can be made small. On the other hand, when a rectangular mold is employed, while bulges are formed on the narrow sides, the narrow sides of the cast slab in an area just after the slab has left the mold to the roll reduction zone are cooled in the same controlled manner to form a solidified shell having a predetermined thickness on both the narrow sides of the cast slab.

In either case, however, when the solidified shell thickness on the narrow sides is larger than a predetermined level, the solidified shell on the narrow sides is not deformed to bend, so that the narrow sides are extended in the casting direction by deformation in the same manner as when the conventional rectangular mold is employed, resulting in the danger of vertical cracking. Thus, it is necessary to control cooling of the narrow sides in such a manner that a solidified shell thickness is made large enough to restrict the amount of deformation in the casting direction to be smaller than the critical strain for cracking, and to restrict the amount of deformation by bending to be smaller than the critical strain.

In this embodiment, the solidified shell thickness may be adjusted to be within 10–90% of the cast slab thickness, and squeeze reduction is applied to this cast slab with a reduction of 5–50% based on the thickness of the cast slab.

The total reduction is determined depending on the thickness of the slab just after casting, the target thickness of the slab, etc. and a possible maximum of the total reduction, i.e., the reduction at the time when both the interfaces meet, can be described by the following formula (2), in which $L_t$ is the thickness of the unsolidified phase remaining in the first reduction zone, and $S_t$ is the increment of the solidified shell after solidification within the roll reduction zbne.

$$Pmax=L_t-S_t \quad (2)$$

When the thickness of an unsolidified phase in the center portion of the slab at the beginning of roll reduction is less than 10% of the total thickness of the slab, the maximum value of the total reduction is so small that the resulting slab is not sufficiently thin to be supplied to a direct rolling process. On the other hand, when the thickness is over 90%, the solidified shell sometimes breaks, resulting in a breakout of molten steel during squeeze reduction.

When the reduction during squeeze reduction is less than 5% of the thickness of the cast slab, it is not necessary to carry out squeeze reduction. When the reduction is over 50%, tensile strains become large at the solid-liquid interface near the corners of the cast slab and at the solid-liquid interface in the central portion of the wide sides of the cast slab, producing the danger of internal cracking. Preferably, the reduction is 10–45%.

In another embodiment of the present invention, cooling of the narrow sides of a slab cast with a rectangular mold can be controlled such that the cast slab has a projection at the center portion of each narrow side with a height of 5–10 mm at the beginning of squeeze reduction, and such that squeeze reduction with a reduction of 10–45% is carried out while the thickness of an unsolidified phase within the slab is 50–80% of the cast slab thickness.

In the above embodiment, the reason why the thickness of the unsolidified phase in the center portion of the slab is defined as 50–80% at the beginning of squeeze reduction is as follows. When the thickness is below 50%, internal cracking cannot be suppressed sufficiently. When the thickness is over 80%, the solidified shell is broken, resulting in the danger of a breakout. Preferably, the thickness is 60–75%.

In this respect, when the reduction during squeeze reduction is less than 10%, center segregation of the slab cannot be removed successfully. When the reduction is over 45%, cracking occurs on the wide sides of the slab. Preferably the reduction is 20–40%.

Practical procedures for controlling the cooling of the narrow sides of the slab so as to prepare a solidified shell thickness sufficiently thick to prevent corner cracking of the slab will be described in detail.

The following description is made with reference to a rectangular mold, but the same procedures of cooling the narrow sides of the slab can be applied with a convex mold except that bulging is performed.

First, a mold having a thickness of 60 mm–150 mm is installed in a continuous casting machine. Molten metal is supplied to a mold cavity through an immersion nozzle from a tundish provided above the continuous casting machine so as to carry out continuous casting. The mold is provided with a cooling system comprising slits or cooling pipes installed within the mold body. The cooling of the wide sides and narrow sides can be controlled independently of each other. If the narrow sides are cooling extensively, the temperature of the narrow side surfaces of the slab is lowered, resulting in thickening of the solidified shell thickness.

According to the present invention, in order to bring about bulging after the slab leaves the mold, the narrow sides are cooled slightly to prepare a cast slab having a small thickness of the solidified shell at the narrow sides of the slab.

Figure 5:
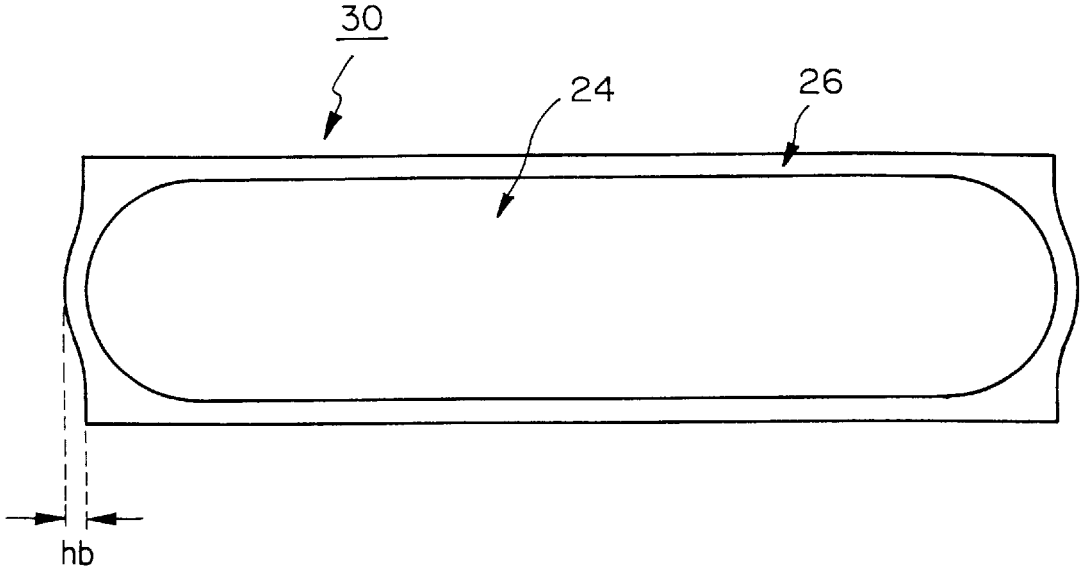
FIG. 5 is a sectional view of a cast slab which shows formation of bulging on the narrow sides of the cast slab which is produced using a rectangular mold in accordance with the present invention.

FIG. 5 is a cross-sectional view of a cast slab 30 at the beginning of squeeze reduction in accordance with the present invention, the slab 30 having a liquid core 24 inside a solidified shell 26. The distance hb indicates the amount of bulging.

In the above-mentioned embodiment of the present invention, due to the formation of bulging caused by slight cooling of the narrow sides of the slab, the shape of the narrow sides is a convex shape having a swelling in the central portion thereof. The central portion is projected by a distance hb=5–10 mm, for example, from the level of the edges of the narrow side. When the projection is shorter than the above range, the narrow side of a section of the mold is similar to a narrow side of a rectangular shape, resulting in less improvement in preventing vertical cracking. On the other hand, if the projection is larger than the above-mentioned range, there is the danger of breakout of the shell due to a small solidified shell thickness.

Figure 6:
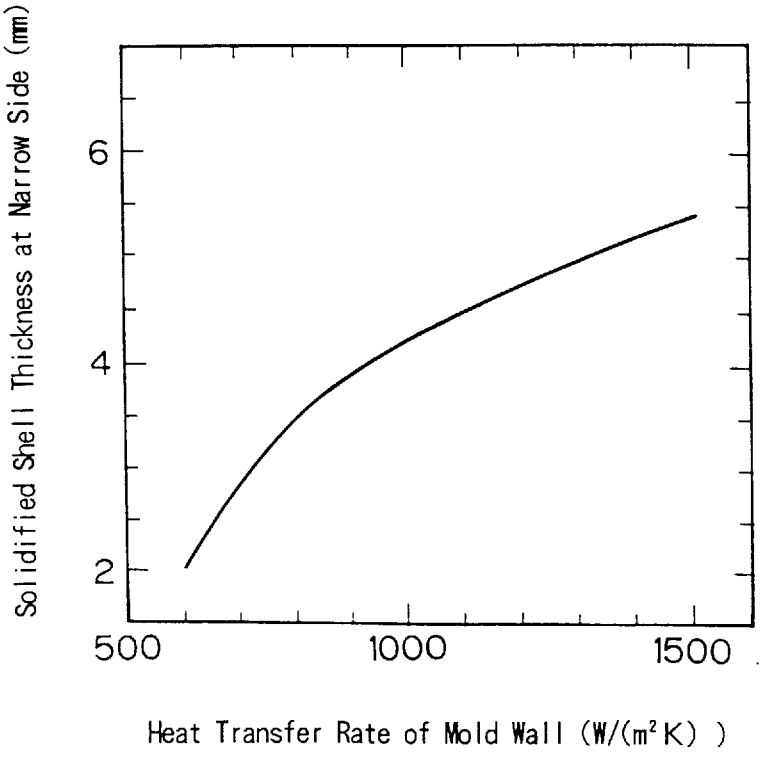
FIG. 6 is a graph showing the relationship between the heat transfer rate of the mold wall at the narrow sides and the thickness of a solidified shell at the narrow sides of the mold.

FIG. 6 shows the relationship between the heat transfer rate of the mold wall at the narrow sides and thickness of the solidified shell at the narrow sides of the mold while the mold is being cooled. In order to obtain a predetermined height of bulging based on the relationship shown in FIG. 8, the narrow sides can be cooled based on the relationship shown in FIG. 6 so as to obtain a necessary solidified shell thickness at the narrow sides.

Figure 7:
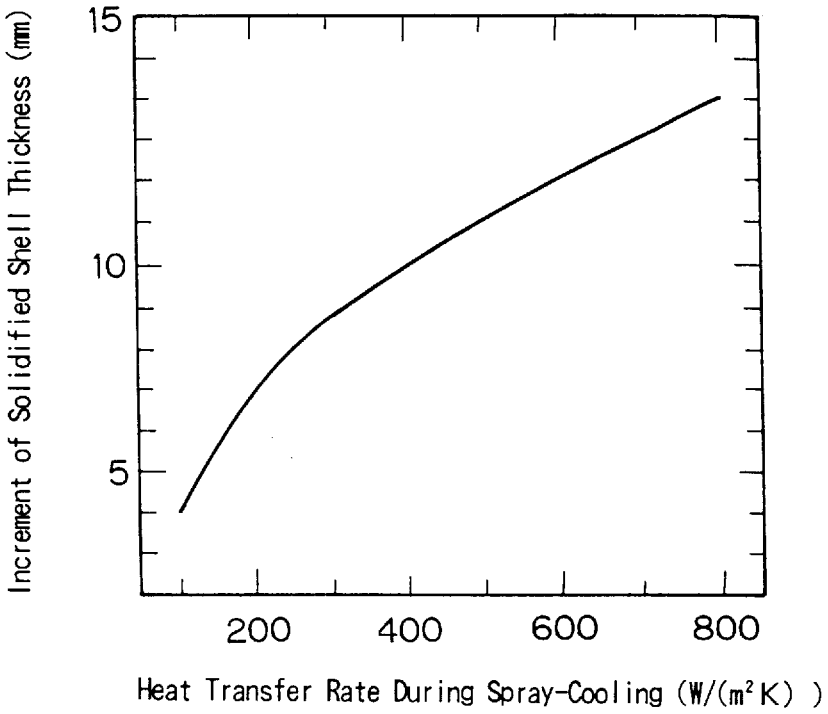
FIG. 7 is a graph showing the relationship between the heat transfer rate of the mold wall at the narrow sides during spray-cooling after the slab leaves the mold and the increment of solidified shell thickness before the slab enters the reduction zone.

FIG. 7 shows the relationship between the heat transfer rate of the mold wall at the narrow sides during spray-cooling after the slab leaves the mold and the increment of solidified shell thickness before the slab goes into the reduction zone. Since the thickness of the solidified shell can be adjusted by controlling the cooling conditions of the slab after it leaves the mold, cooling of the slab, particularly at the narrow sides, is carried out in accordance with the present invention such that not only can a necessary amount of bulging be obtained, but also such that a sufficient thickness of the solidified shell to prevent corner cracking is obtained before the slab goes into the squeeze reduction zone.

Figure 8:
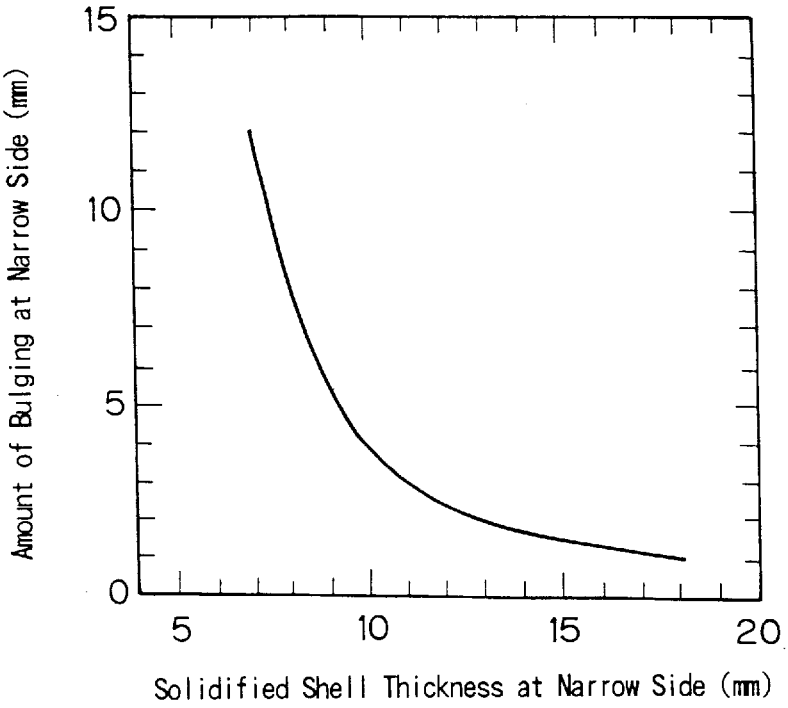
FIG. 8 is a graph showing the relationship between the thickness of a solidified shell at the narrow side of the mold and the amount of bulging at the narrow sides of the mold before the slab enters the reduction zone when a rectangular mold is used but spray-cooling is not employed.

FIG. 8 shows the relationship between the shell thickness at the narrow sides and the amount of bulging at the narrow sides.

When the necessary amount of bulging at the narrow sides is 5–10 mm, it can be seen from FIG. 8 that the thickness of the solidified shell at the narrow sides is 7–9 mm in order to bring about such a degree of bulging. Thus, it is necessary to adjust the solidified shell thickness to be such a level as the above at the time when the cast slab leaves a rectangular mold or during the time when the cast slab is cooled in a spray-cooling zone. The cooling conditions for the mold for these purposes can be determined from FIG. 6. On the other hand, provided that the thickness of the solidified shell which is free from cracking at the narrow sides during squeeze reduction is 9–25 mm, for example, it can be determined from FIG. 7 how much increment of the solidified shell thickness is necessary for that purpose and then what are the necessary cooling conditions for the narrow sides of the slab.

According to the present invention, even if a rectangular mold is used, when the narrow sides of the mold are slowly cooled, bulges are formed intentionally at the narrow sides of the slab, resulting in a cast slab having convex narrow sides, not straight narrow sides. When squeeze reduction is applied to a cast slab having bulges on the narrow sides, introduction of tensile strains along the liquid-solid interface in the longitudinal section during squeeze reduction are suppressed, and vertical cracking is prevented.

Bulging on the narrow sides, i.e., the distance hb in FIG. 5 is 5–10 mm. Preferably, it is 6–8 mm. When the bulging is less than 5 mm, the improvement in suppression of tensile strains is not achieved thoroughly. When the distance hb is over 10 mm, the thickness of the solidified shell is too thin to avoid the danger that the solidified shell breaks to result in the breakage of the slab as it passes from the mold to the rolling reduction zone, or during squeeze reduction.

According to the present invention, since the thickness of the solidified shell at the narrow sides can be changed by controlling the cooling of the narrow sides of the slab, it is possible to achieve a predetermined thickness at the narrow sides of the solidified shell at the entrance of the squeeze reduction zone. This means that it is possible to produce thin slabs of good quality which are free of not only vertical cracking, but also corner cracking and center segregation, regardless of casting conditions.

Another example of producing clean steel will be described, in which a mold provided with an EMBr is employed to improve the cleanliness of the steel.

Figure 9:
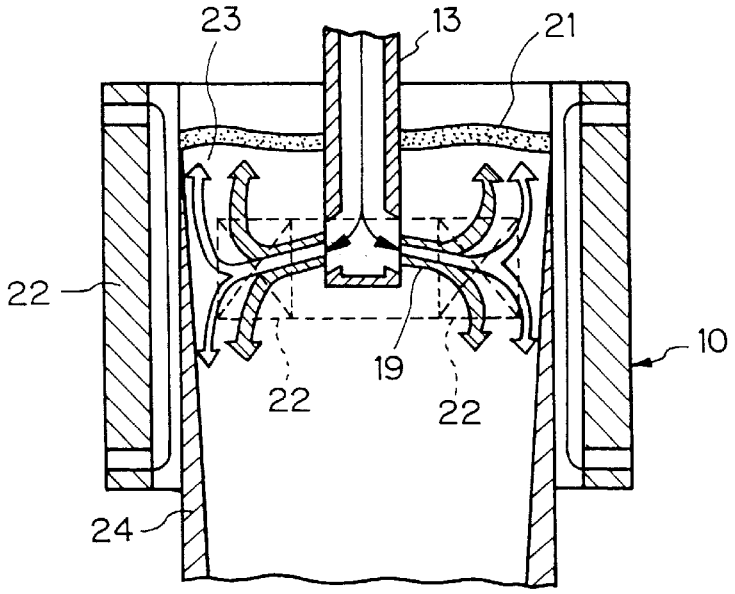
FIG. 9 is a schematic view of a vertical section of the mold, its neighborhood, and the EMBr arrangement, in which pouring streams are indicated.

FIG. 9 is a schematic vertical sectional view of an arrangement of a mold 10 and its neighboring portions provided with an EMBr 22 and flows of molten steel. An immersion nozzle 13 is of a conventional two-hole type, with the discharge direction thereof being in the same direction as the direction of the wide sides (width) of the mold 10, i.e., the direction to the narrow sides, namely right-hand and left-hand directions on the drawings. The EMBr 22 comprises electromagnetic coils and can provide an electromagnetic field in which magnetic fluxes penetrate discharged flows 19 from discharge ports of an immersion nozzle 13. The direction of the magnetic field is against the flow 19 of molten steel.

In a case in which the EMBr 22 is not used, a discharged flow 19 of molten steel from the immersion nozzle 13 passes toward the narrow sides of the mold 10, and the flow is divided into an upward flow and a downward flow, as shown by open arrows in FIG. 9. The upward flow heads for a free surface 23 within the mold 10. Since the upward flow carries heat to the meniscus portion of the molten steel within the mold 10, if the flow rate of the upward flow is smaller than required, there will be troubles such as freezing of a molten metal surface in the mold. On the other hand, if the flow rate is larger than the requisite, swelling of the molten metal surface occurs increasingly with a fluctuation in surface level, resulting in problems such as inclusion of melted powder 21. In addition, when the flow strikes the narrow sides of the mold at a high speed, a solidified shell 24 is re-melted, resulting in a delay in solidification in this portion. In the worst case, a breakout will occur in a lower portion of the mold 10.

In contrast, when the EMBr 22 is employed to apply a suitable braking action, the discharged flow 19 is braked as shown by hatched arrows in FIG. 9, so that striking against the narrow sides is moderated, diminishing such problems as mentioned above.

Next, preferred operating conditions at the time when the electromagnetic braking is applied will be described. In the following example of squeeze reduction, rectangular cast slabs are employed for clarification of the description.

Under usual continuous casting without using squeeze reduction, the thickness of the slab which is obtained is the same as the thickness of the mold (inner dimension of the narrow side).

However, according to the squeeze reduction process in which a cast slab leaving the mold and having the same thickness as the mold is subjected to reduction in a reduction zone downstream of the mold, since the thickness of the slab is reduced, the throughput of the molten steel decreases so that the discharge flow rate from the immersion nozzle within the mold also decreases. The throughput is defined by the formula $[(L \cdot W \cdot Vc) \times \rho]$ (ton/min) wherein L stands for the slab thickness (m), W stands for the slab width (m), Vc stands for the casting speed (m/min), and p stands for the density of molten steel (ton/$m^3$).

Thus, the magnetic field intensity which is required in the case in which squeeze reduction is not applied is much higher than that required in the case in which squeeze reduction is applied. Such an excessively high magnetic field intensity causes an excessively high braking force, resulting in a fluctuation in the molten metal surface caused by an increase in a flow rate of upward flows, and also resulting in molten steel residence near the narrow sides of the mold. These also lead to problems such as freezing of the molten steel surface contacting the inner wall of the mold.

In order to avoid these problems, it is desirable in accordance with the present invention that the magnetic field intensity provided for electromagnetic braking be controlled depending on the reduction $\Delta L$ ($=L_0-L_1$) in a manner defined by the before-mentioned Formula (1).

Figure 10:
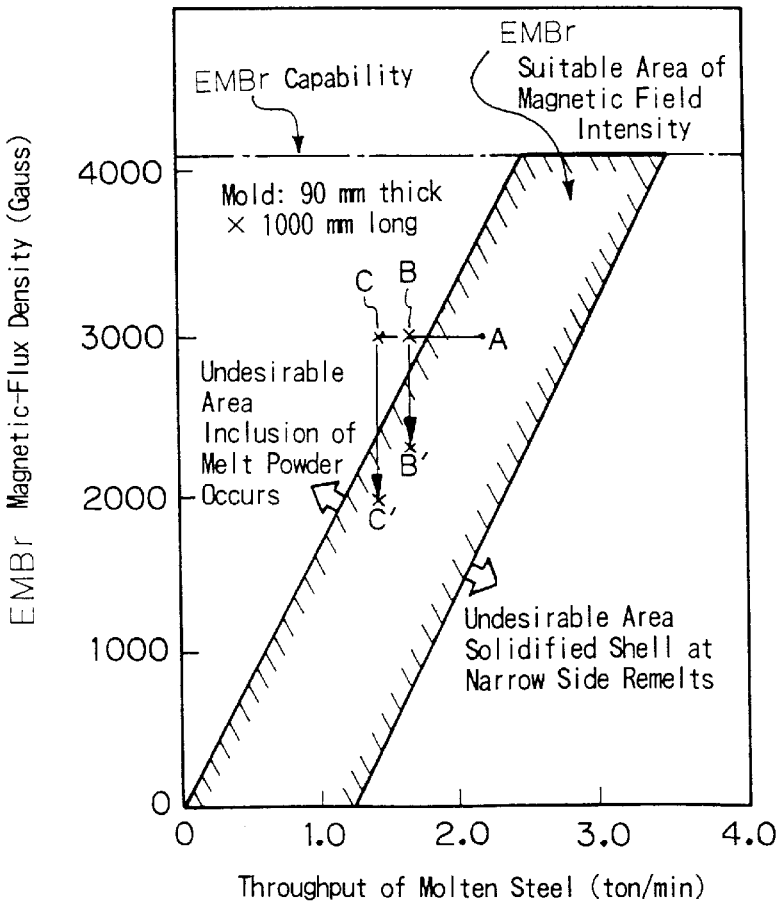
FIG. 10 is a graph showing the relationship between the throughput of molten steel and magnetic flux density of the EMBr.

FIG. 10 is a graph showing the relationship between the throughput of molten steel and the magnetic flux density of the EMBr. The data shown in FIG. 10 are conventional casting conditions for molding using a mold having a cavity of a width of 1000 mm and a thickness of 90 mm and not employing squeeze reduction. The data are previously generalized with respect to the throughput. In the drawings, the hatched area indicates an area in which the magnetic field intensity is suitable.

It will be noted from the above that if the process of the present invention is controlled in accordance with Formula (1), the casting operation can be performed within such a suitable area as shown in FIG. 10.

In the case shown in FIG. 10, if squeeze reduction is not applied, it is necessary to adjust the throughput to be 1.27 ton/min or less (Vc=2.0 m/min). If the throughput is larger than this, i.e., if Vc is 2.0 m/min or more, the operating conditions go into an undesirable area where a solidified shell at the narrow sides remelts unless a magnetic field is applied with the EMBr.

On the other hand, when the magnetic field intensity applied with the EMBr is excessively larger than required and an excessive braking force is applied to the molten steel flows, a flow rate of the upward flows from the immersion nozzle increases, and as shown in FIG. 10, the operating conditions go into an undesirable area where inclusion of melted powder occurs due to a fluctuation in the molten metal surface.

By way of example, when squeeze reduction is not employed and the thickness of the cast slab is 90 mm, under usual conditions, the magnetic field intensity (magnetic flux density) with the EMBr is about 3000 Gauss at a casting speed of Vc=3.5 m/min. This case can be indicated by point A in FIG. 10. In contrast, if the slab thickness is decreased from 90 mm to 20 mm and 30 mm, respectively, and squeeze reduction is employed, while the casting speed is kept at 3.5 m/min, the throughputs are 1.72 ton/min and 1.47 ton/min, respectively. Thus, if the magnetic field intensity of 3000 Gauss is applied, the casting conditions move to points B and C, respectively, and go into an undesirable area where inclusion of melted powder occurs.

According to the present invention, however, since the magnetic field intensity is changed in the manner defined in Formula (1), the operating conditions move to points B' and C', respectively, in FIG. 10, which fallen in a suitable range of the magnetic field intensity. This is because the magnetic field intensity is 2340 Gauss after the reduction in 20 mm at the ratio (0.78) of throughput before and after the reduction, and because the magnetic field intensity is 2010 Gauss after the reduction in 30 mm at the ratio (0.67) of throughput before and after the reduction.

As a result, inclusion of melted powder can be prevented successfully, and surface conditions of the slab can be improved, resulting in improvement in the cleanliness of steel.

EXAMPLE

The effects of the present invention will be explained further in detail with reference to the following working examples.

(Example 1)

The process of the present invention was carried out using a continuous casting machine (length: 12.6 m) of the curved type having the structure shown in FIG. 3, in which was installed a trapezoidal mold (inner width: 1000 mm, thickness=narrow side length: 100 mm) having a vertical length of 900 mm and being provided with independent cooling control systems for the wide sides and narrow sides.

The narrow side of the mold employed in this example had the shape shown in Table 1. Symbols such as a, b, and h shown therein correspond to the symbols a, b, and h of FIG. 4.

The casting machine comprised, at a distance of from 3.2 m to 5.8 m from the meniscus, a total of 18 reduction rolls which constituted a reduction zone divided into three segments for achieving squeeze reduction, 12 guide rolls, and spraying cooling means provided between the guide rolls and capable of cooling the wide and narrow sides independently.

The roll reduction was carried out with the same reduction gradient for each of the reduction zones. The cooling of the mold was controlled so that the heat transfer rate through the mold was 1720 W/($m^2$·K). The spray cooling was also controlled so that the heat transfer rate was 1000 W/($m^2$·K). Namely, the cooling was controlled so that the solidified shell on the narrow sides was about 20–25 mm at the entrance of the reduction zone. This thickness of the solidified shell was thought to be the most suitable in view of conventional operating data including shapes of the narrow sides of molds, reduction strains, etc.

Under the conditions of a casting speed of 4.5 m/min and a reduction during squeeze reduction of 30 mm, thin cast slabs having a thickness of 70 mm were obtained in the above-described continuous casting machine. The slab comprised a steel composition of C: 0.11 wt %, P: 0.02 wt %, and S: 0.008 wt %.

The resulting slabs were examined with respect to internal defects (vertical cracks, corner cracks, center segregation). For comparison, continuous casting was carried out in the same way except that the heat transfer rate through the mold was set to be 800 W/($m^2$·K), but spray cooling was not used. The resulting slabs were also examined in the same manner.

Figure 1A:
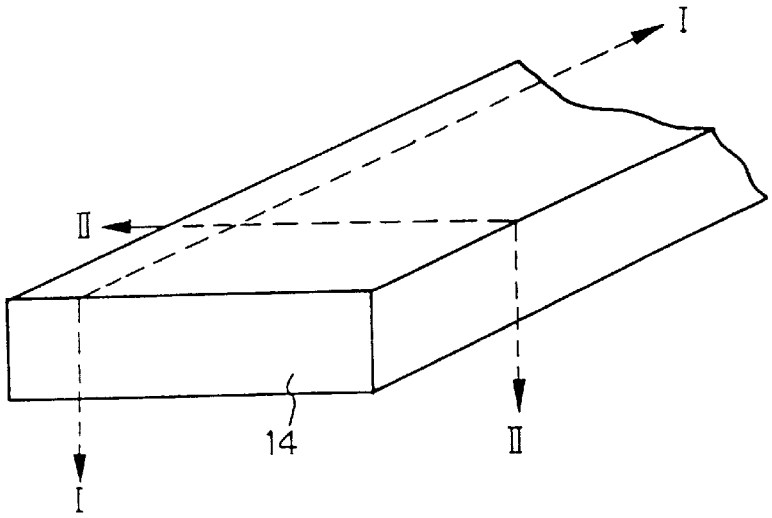
Figure 1B:
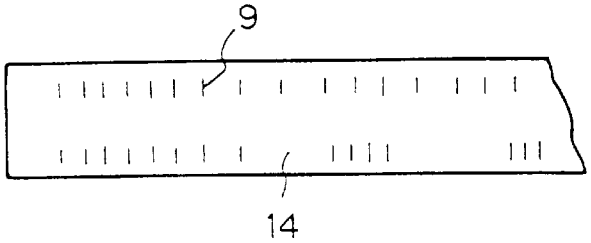
Figure 1C:
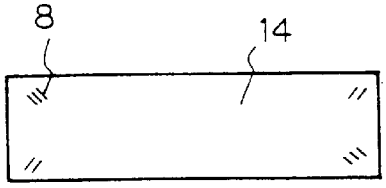
Figure 2:
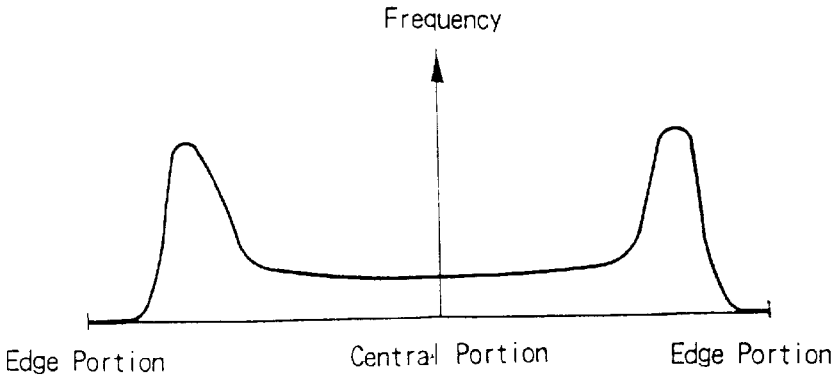
FIG. 2 is a graph showing the frequency of occurrence of cracking from the central portion to the edge portions of the slab in the cross section of FIG. 1*c*.

The results are shown in Table 2, in which the vertical cracking was determined by the maximum number of cracks having a length of 1 mm or longer in the longitudinal section over a distance of 1 m in the longitudinal direction near the edge portions (the maximum number of vertical cracks at the point of the maximum frequency of occurrence in FIG. 2). The corner cracking was also determined by the number of corner cracks having a length of 1 mm or more in the cross section. In the remarks column, the symbol ◎ means no cracking at all, and the symbol X means 10 or more internal cracks having a length of 1 mm or longer. Center segregation means carbon segregation in the center of the slab, and can be described by the center segregation rate S defined by the following formula: S=Cm/Co (Co: initial carbon concentration, Cm: carbon concentration in the center of the slab). In the remarks column, the symbol ◎ means the center segregation rate S is 1.07 or less, which also means that the segregation is very small.

As is apparent from the results shown in Table 2, thin slabs which were obtained by cooling in a conventional manner and then squeeze reduction had internal defects such as vertical cracking, although the center segregation rate was as small as for the thin slabs of the present invention. In contrast, the thin slabs cast in accordance with the process of the present invention had small center segregation, and there was substantially no vertical cracking and corner cracking. These slabs were evaluated as "good".

(Example 2)

Using the same continuous casting machine as in Example 1, which was provided with a mold similar to that used in Example 1, slabs were produced at a casting speed of 4.0, 4.5, or 5.0 m/min. The resulting slabs were subjected to rolling with a reduction of 40 mm to produce thin slabs with a thickness of 60 mm. The steel composition thereof was the same as in Example 1. Cooling of the slabs were controlled in such a way to adjust the thickness of a solidified shell at the narrow sides to be 25–30 mm at the entrance of the reduction zone. This thickness of the solidified shell was thought to be the most suitable in view of conventional operating data including shapes of the narrow sides of molds, reduction strains, etc. Table 3 shows heat transfer rates through the mold and by spray cooling.

The slabs were examined for internal defects in the same manner as in Example 1. The results are shown in Table 4, in which the symbol ⊙ means that there was no vertical cracking or corner cracking, and that the center segregation rate S was as small as 1.07 or less.

As is apparent from these results, regardless of the casting speed, every thin cast slab had a small center segregation and was free of internal cracking and of breakout.

(Example 3)

In this example, Example 1 was repeated except that the thickness within the mold was 80 mm, the shape of the narrow side thereof was straight, trapezoidal, or circular, and the casting speed was 5.0 m/min.

Table 5 shows the shape of the narrow sides of the mold, cooling conditions, and the solidified shell thickness on the narrow side of the mold at the entrance to the reduction zone. In Table 5, Nos. 1, 2, and 6 were the cases in which forced cooling was carried out. Nos. 1 and 2 were the cases in which the shapes of the mold fell outside the present invention. Nos. 3 and 4 were the cases in which the solidified shell thickness on the narrow sides were rather thin compared with that thought to be most suitable in view of conventional operating data, since the cooling was carried out slowly. Nos. 4 and 6 were the cases of the present invention.

The slabs were examined for internal defects in the same manner as in Example 1. The results are shown in Table 6, in which regarding vertical cracking and corner cracking, the symbol ⊙ means that there was no cracking at all, the symbol Δ means that the number of cracks of 1 mm or longer was 5 or more but less than 10, and the symbol X means that the number of cracks of 1 mm or longer was 10 or more. Regarding center segregation, the symbol ⊙ means that the center segregation rate S was as small as 1.07 or less.

As is apparent from these results, regardless of the casting conditions, corner cracking and vertical cracking were inevitable when a mold with straight narrow sides was used.

In contrast, when a mold having trapezoidal or circular narrow sides was employed, unless the narrow sides of the mold were cooled strongly (Nos. 3 and 5), bending deformation was introduced to the narrow sides of the cast slab, resulting in inner cracking near the corner portions, i.e., corner cracking. However, when the narrow sides of the slabs were cooled strongly (Nos. 4 and 6), the narrow sides were free of bending deformation, and there was no corner cracking. Regarding vertical cracking, Nos. 3–6 were free of them in spite of cooling conditions.

TABLE 1

| Dimension | Trapezoid (mm) |
|---|---|
| a | 5.0 |
| b | 20.0 |
| h | 20.0 |

TABLE 2

| | Inner Cracks (Number) | | | Center Segregation | |
|---|---|---|---|---|---|
| | Evaluation | Vertical Cracks | Corner Cracks | Evaluation | Center Segregation |
| Present Invention | ⊙ | 0 | 0 | ⊙ | 1.05 |
| Conventional | X | 40 | 15 | ⊙ | 1.05 |

TABLE 3

| Casting Speed | Heat Transfer Rate [W/(m$^2$ · K)] | |
|---|---|---|
| (m/min) | Mold Cooling | Spraying |
| 4.0 | 1800 | 1000 |
| 4.5 | 2000 | 1200 |
| 5.0 | 2200 | 1400 |

TABLE 4

| Casting | Inner Cracking | | |
|---|---|---|---|
| Speed (m/min) | Vertical Cracking | Corner Cracking | Center Segregation |
| 4.0 | ⊙ | ⊙ | ⊙ |
| 4.5 | ⊙ | ⊙ | ⊙ |
| 5.0 | ⊙ | ⊙ | ⊙ |

TABLE 5

| Run | Shape of | Heat Transfer Rate [W/(m$^2$ · K)] | | Solidified Narrow side Shell Thick- |
|---|---|---|---|---|
| No. | Narrow side | Mold Cooling | Spraying | ness (mm) |
| 1 | Straight | 700 | 200 | 9.3 |
| 2 | Straight | 2000 | 1200 | 24.6 |
| 3 | Trapezoidal | 700 | 200 | 9.3 |
| 4 | Trapezoidal | 2000 | 1200 | 26.6 |
| 5 | Circular | 700 | 200 | 9.3 |
| 6 | Circular | 2000 | 1200 | 24.6 |

TABLE 6

| | Inner Cracking | | |
|---|---|---|---|
| Run No. | Corner Cracking | Vertical Cracking | Center Segregation |
| 1 | Δ | x | ⊙ |
| 2 | Δ | Δ | ⊙ |
| 3 | Δ | ⊙ | ⊙ |
| 4 | ⊙ | ⊙ | ⊙ |
| 5 | Δ | ⊙ | ⊙ |
| 6 | ⊙ | ⊙ | ⊙ |

(Example 4)

The process of the present invention was carried out using a continuous casting machine (length: 12.6 m) of the curved type having a structure substantially corresponding to that shown in FIG. 3. A rectangular mold having a vertical length of 900 mm and provided with independent cooling control systems for the wide sides and narrow sides was installed in the casting machine. The casting machine comprised, at a distance of from 3.2 m to 5.8 m from the meniscus, 18 reduction rolls for squeeze reduction. Casting was carried out at a casting speed of 4.5 m/min to produce thin slabs.

The cooling of the narrow sides of the mold was controlled so that the heat transfer rate through the mold was 665 W/($m^2$·K). The spray cooling was also controlled so that the heat transfer rate was 185 W/($m^2$·K). As a result, bulging at the center of the narrow sides was 8 mm, and the solidified shell on the narrow sides was 48 mm thick.

The cast slabs were shaped into dimensions of 1000 mm (width) by 100 mm (thickness) within the mold. After squeeze reduction with a reduction of 30 mm, the thickness was reduced to 70 mm. The composition comprised [C]=0.11%, [P]=0.02%, and [S]=0.008%.

The roll reduction was carried out with a constant reduction incline of alignment for each of the reduction zones. The reduction rate was 30% at the time when the thickness of the unsolidified portion on the narrow sides of the slab was 60% of the total thickness of the slab on the narrow sides thereof.

In addition, continuous casting was carried out using a rectangular mold without controlling the cooling of the narrow sides of the mold as in the conventional process.

The results are shown in Table 7.

As is apparent from the results shown therein, thin slabs obtained by casting and cooling them in a conventional manner and then subjecting the cast slabs to squeeze reduction had a small center segregation rate, but had corner cracking and vertical cracking.

In contrast, the thin slabs obtained by casting and squeeze reduction in accordance with the present invention were free of center segregation, vertical cracking, and corner cracking.

TABLE 7

| | Inner Cracks (Number) | | | Center Segregation | |
|---|---|---|---|---|---|
| | Evaluation | Vertical Cracks | Corner Cracks | Evaluation | Center Segregation |
| Present Invention | ⊙ | 0 | 0 | ⊙ | 1.05 |
| Conventional | x | 20 | 20 | ⊙ | 1.05 |

(Example 5)

In the continuous casting machine of Example 4, a mold having a rectangular cavity 1000 mm wide and 80 mm thick and having a cooling system to control cooling of the wide sides and narrow sides independently was installed. Continuous casting was carried out at a casting speed of 4.0. 4.2, 4.4, 4.6, 4.8, or 5.0 m/min to produce slabs with a thickness of 60 mm and a bulge of 5.8 mm. The steel composition of the cast slab was the same as in Example 4. The cast slabs were reduced by 20 mm in thickness by the same reduction rolls as used in Example 4. Reduction was carried out with a reduction rate of 20% at the time when the thickness of the unsolidified portion on the narrow sides of the slab was 48 mm and with a reduction incline.

Controlled cooling was carried out in such a manner that the solidified, narrow side shell thickness was 9 mm at the entrance of the reduction zone. The heat transfer rates for mold cooling and spraying are shown in Table 8, in which symbol ⊙ in the cracking evaluation column means that there was no cracking at all, and symbol ⊙ in the center segregation evaluation column means that the center segregation rate S was 1.07 or less, and so the segregation was small.

Casting test results are shown in Table 9.

As is apparent from these results, regardless of the casting speed, there was no center segregation, vertical cracking, or corner cracking at all, and breakout did not occur.

TABLE 8

| Casting Speed | Heat Transfer Rate [W/($m^2$ · K)] | |
|---|---|---|
| (m/min) | Mold Cooling | Spraying |
| 4.0 | 591.1 | 164.4 |
| 4.2 | 620.7 | 172.7 |
| 4.4 | 650.2 | 180.9 |
| 4.6 | 679.8 | 189.1 |
| 4.8 | 709.3 | 197.3 |
| 5.0 | 738.9 | 205.6 |

TABLE 9

| Casting | Inner Quality | | |
|---|---|---|---|
| Speed (m/min) | Vertical Cracking | Corner Cracking | Center Segregation |
| 4.0 | ⊙ | ⊙ | ⊙ |
| 4.2 | ⊙ | ⊙ | ⊙ |
| 4.4 | ⊙ | ⊙ | ⊙ |
| 4.6 | ⊙ | ⊙ | ⊙ |
| 4.8 | ⊙ | ⊙ | ⊙ |
| 5.0 | ⊙ | ⊙ | ⊙ |

(Example 6)

In the continuous casting machine of Example 4, a mold having a rectangular cavity which was 1000 mm wide and 100 mm thick and which had a cooling system to control cooling of the wide sides and narrow sides independently was installed. Continuous casting was carried out at a casting speed of 4.5 m/min under varied cooling conditions to provide thin cast slabs which were 70 mm thick, the steel composition of which was the same as in Example 4. The cast slabs were reduced by 30 mm in thickness by the same reduction rolls as used in Example 4. Table 10 shows cooling conditions, the solidified shell thickness on the narrow sides at the entrance of the reduction zone, and the height of projection, i.e., the amount of bulging. Reduction was carried out at the time when the thickness of the unsolidified portion on the narrow sides of the slab was 65% of the total thickness of the slab, and a constant reduction incline was employed through the reduction zone.

The inner quality of the cast slabs is summarized in Table 11. The case in which casting was inoperable is indicated by the symbol X, and the case in which the number of cracks was 10 or more is indicated by the symbol X. The other evaluations are the same as in Table 9. When the solidified shell thickness was less than 7 mm, such a thin shell at the narrow sides broke upon reduction, making the casting inoperable. On the other hand, when the solidified shell thickness was larger than 12 mm, the amount of bulge at the narrow sides was small and there was no center segregation, but inner cracking was inevitable.

In contrast, when the solidified shell thickness was between 8 mm and 12 mm, vertical cracking and corner cracking did not occur.

TABLE 10

| | Heat Transfer Rate [W/(m² · K)] | | Solidified Narrow side Shell Thickness (mm) | Height of Shape (mm) |
|---|---|---|---|---|
| | Mold Cooling | Spraying | | |
| ① | 600.0 | 120.0 | <7.0 | 12.0 |
| ② | 600.0 | 150.0 | 7.9 | 8.2 |
| ③ | 700.0 | 150.0 | 8.6 | 6.3 |
| ④ | 700.0 | 200.0 | 9.3 | 5.0 |
| ⑤ | 800.0 | 300.0 | 12.3 | 2.1 |
| ⑥ | 800.0 | 400.0 | 13.5 | 1.8 |
| ⑦ | 900.0 | 500.0 | 15.8 | 1.5 |

TABLE 11

| | Applicability of Casting | Inner Cracking | | |
|---|---|---|---|---|
| | | Vertical Cracking | Corner Cracking | Center Segregation |
| ① | x | — | — | — |
| ② | ○ | ◎ | ◎ | ◎ |
| ③ | ○ | ◎ | ◎ | ◎ |
| ④ | ○ | ◎ | ◎ | ◎ |
| ⑤ | ○ | x | x | ◎ |
| ⑥ | ○ | x | x | ◎ |
| ⑦ | ○ | x | x | ◎ |

(Example 7)

Continuous casting of steel was carried out using a continuous casting machine like that shown in FIG. 3 (the length of the vertical portion: 1.5 m, the curvature radius of the following portion: 3 m, and reduction zone: first to fourth segments) under the conditions shown below and in Table 12. The surface appearance of the slab was examined to determine whether powder inclusion occurred.

Mold: 90 mm inner thickness of mold cavity, 1000 mm inner width of mold cavity, and 900 mm long.

Distances from the meniscus of molten steel within the mold:

To the inlet of the first segment: 3000 mm

To the inlet of the second segment: 4000 mm

To the inlet of the third segment: 5000 mm

To the inlet of the fourth segment (no reduction): 6000 mm

To the outlet of the fourth segment (no reduction): 7500 mm

Steel: Medium Carbon Steel (C: 0.11%)

Molten Steel Temperature: 1558° C. (Liquidus Temp.: 1528° C.)

Casting Speed: 3 5 m/min

Squeeze reduction before Solidification: Employed/Not Employed (Yes/No)

TABLE 12

| | Case | Squeeze Reduction: Yes or No | Squeeze Reduction: Reduction (mm) | Slab Thickness: After Leaving Mold (mm) | Slab Thickness: After Reduction (mm) | Throughput of Molten Steel ton/min) | Magnetic Field Intensity within Mold (gauss) | Surface Appearance of Slabs (Powder Inclusions) |
|---|---|---|---|---|---|---|---|---|
| (1) | A | No | 0 | 90 | 90 | 2.21 | 3000 | None |
| (2) | B | Yes | 20 | 90 | 70 | 1.72 | 3000* | Yes |
| | C | Yes | 30 | 90 | 60 | 1.47 | 3000* | Yes |
| (3) | B' | Yes | 20 | 90 | 70 | 1.72 | 2340** | None |
| | C' | Yes | 30 | 90 | 60 | 1.47 | 2010** | None |

*: Same as Case A,
**: Intensity by the ratio of throughput
(1): Comparative,
(2): Conventional,
(3): Present Invention When squeeze reduction was carried out, cast slabs measuring 90 mm thick from the mold were subjected to reduction of 20 mm and 30 mm in the first segment to reduce the thickness to 70 mm and 60 mm, respectively (see cases B, C, B', and C' of Table 12). When squeeze reduction was not employed (Case A of table 12), the final thickness of the product slab was the same as the thickness of the mold cavity, i.e., 90 mm.

When squeeze reduction with a reduction of 20 mm or 30 mm was applied (Case B' and Case C'), the throughput was equal to 0.78 times and 0.67 times, respectively, the throughput of Case A in which no squeeze reduction was employed. The magnetic field intensity, therefore, was also adjusted to be equal to 0.78 times and 0.67 times, respectively, that of Case A. Thus, the magnification of the throughput and magnetic field intensity were made equal to each other.

Table 12 summarizes the results of observation. As is shown in Case B' and Case C' of Table 12, when squeeze reduction was employed and a suitable intensity of the braking magnetic field given by the EMBr on the basis of the ratio of (throughput after squeeze reduction)/(throughput before squeeze reduction) was applied, casting results were obtained which were superior to those of Case B and Case C in which squeeze reduction was applied without changing the intensity of the magnetic filed of EMBr.

INDUSTRIAL APPLICABILITY

According to the continuous casting process of the present invention, thin slabs having good quality with no inner cracking and no center segregation can be obtained regardless of casting conditions.

We claim:

1. A process for continuously casting a thin slab comprising the steps of:

continuously casting a slab in a mold, and forming said slab with narrow sides;

providing said narrow sides with a convex shape;

cooling said slab in a controlled manner such that a solidified shell is formed which surrounds an unsolidified center portion; and then subjecting said slab to a squeeze reduction operation while said slab still has an unsolidified center portion, said solidified shell formed by controlled cooling having a thickness sufficient to prevent corner cracking during the squeeze reduction operation.

2. The process as set forth in claim 1 wherein the cast slab has a thickness of 50–200 mm prior to squeeze reduction, the solidified shell thickness on the narrow sides is restricted to 20–50% of the thickness of the slab.

3. The process as set forth in claim 1, wherein said mold further comprising narrow sides, each of the narrow sides of said mold having a convex shape, the continuous casting step is carried out using a continuous casting machine which comprises said mold, as well as guide rolls and reduction rolls, said process further comprising the step of:

cooling the narrow sides of said cast slab in a controlled manner while the cast slab is within the mold, and cooling the narrow sides of the cast slab in a controlled manner within a zone just below the mold to just before a reduction zone where said squeeze reduction operation is performed, whereby said cooling step is controlled such that the solidified shell thickness is sufficient to prevent internal cracking of the cast slab.

4. The process as set forth in claim 3 wherein the squeeze reduction operation is performed while the thickness of the unsolidified center portion is 10–90% of the thickness of the cast slab, the squeeze reduction operation causes a reduction in thickness of the cast slab of 5–50%.

5. The process as set forth in claim 1, wherein said mold has flat narrow sides, said process further comprising:

cooling the flat narrow sides of said mold in a controlled manner such that a projection is formed along a center portion of the narrow sides of the cast slab, said projection extending 5–10 mm beyond edges of the narrow sides of the cast slab, and the thickness of the unsolidified center portion is 50–80% of the thickness of the cast slab;

the squeeze reduction operation is performed such that the thickness of the cast slab is reduced by 10–45%.

6. The process as set forth in claim 5 wherein the thickness of the solidified shell at the narrow sides is 7–9 mm.

7. The process as set forth in claim 1 further comprising:

applying a magnetic field to a flow of molten steel flowing from an immersion nozzle into the mold, and applying the magnetic field in a direction opposite the direction of said flow such that the flow of the molten metal into the mold is braked; and controlling the magnetic field intensity based upon a ratio of the throughput of molten steel after the squeeze reduction operation to the throughput of molten steel before the squeeze reduction operation.

8. The process as set forth in claim 7 wherein the magnetic field intensity F is controlled depending on the reduction $\Delta L$ ($=L_0-L_1$) in accordance with the following formula (1):

$$F_1=[(L_0-\Delta L)\cdot W_1/(L_0\cdot W_0)]\cdot F_0$$

wherein F: magnetic field intensity (Gauss)

L: thickness of cast slab (m)

W: width of cast slab (m)

Appendix 0: before squeeze reduction

Appendix 1: after squeeze reduction.

* * * * *